United States Patent [19]

Barbakadze et al.

[11] 4,232,854

[45] Nov. 11, 1980

[54] METHOD OF INTRODUCING POWDERED REAGENTS INTO MOLTEN METALS AND APPARATUS FOR EFFECTING SAME

[76] Inventors: Dzhondo F. Barbakadze, ulitsa Gldanskaya, 6, kv. 35, Tbilisi; Mamuka S. Mindeli, ulitsa Pionerskaya, 8, Rustavi; Petr G. Macharashvili, ulitsa Lenina, 27, kv. 8, Rustavi; Vazha V. Rusidze, prospekt Druzhby Narodov, 57, kv. 64, Rustavi; Otari N. Suladze, Pionersky proezd, 3, Rustavi, all of U.S.S.R.

[21] Appl. No.: 909,990

[22] Filed: May 26, 1978

[51] Int. Cl.[3] ..... C21C 5/48

[52] U.S. Cl. ..... 266/266; 75/53

[58] Field of Search ..... 75/53, 57, 58, 51, 52; 266/266

[56] References Cited

U.S. PATENT DOCUMENTS

| | | | |
|---|---|---|---|
| 1,866,080 | 7/1932 | Brosins | 266/265 |
| 2,803,533 | 8/1957 | Bieniosek | 75/53 |
| 3,368,885 | 2/1968 | Volianik | 75/58 |
| 3,373,981 | 3/1968 | Taubmann | 266/265 |
| 3,514,285 | 5/1970 | Bakkerus | 75/58 |
| 3,520,525 | 7/1970 | Zimmermann | 266/265 |
| 3,558,119 | 1/1971 | Demalander | 266/265 |
| 3,575,695 | 4/1971 | Miyashita | 75/58 |
| 3,610,183 | 10/1971 | Kolboy | 266/265 |
| 3,885,957 | 5/1975 | Richter | 75/58 |
| 3,929,464 | 12/1975 | Todd | 75/58 |
| 3,998,625 | 12/1976 | Koros | 75/53 |
| 4,130,417 | 12/1978 | Breuer | 75/52 |

*Primary Examiner*—P. D. Rosenberg

*Attorney, Agent, or Firm*—Haseltine, Lake & Waters

[57] ABSTRACT

A method of introducing powdered reagents into a molten metal in a stream of carrier gas through a tuyere disposed in a refractory lining of a metallurgical vessel, consisting in that powdered reagents are introduced into a molten metal at a feed rate of 0.04 to 0.6 kg. per sec. under a pressure of carrier gas which is 1.8 to 4.0 times the static pressure of the molten metal above the tuyere, with the powder-to-carrier-gas ratio being 3 to 35 kg per cubic meter; and an apparatus for carrying the method into effect, which comprises a tuyere built in a refractory lining of a metallurgical vessel and accommodating in its interior a tube axially movable therealong and made up of separate sections each being smaller in length than the thickness of the refractory lining, and provided with a plug, a powdered reagent being introduced through said tube in a stream of carrier gas into the metallurgical vessel; there is positioned on the outside of the tuyere a feed device made in the form of a hollow cylinder mounted on its actuator operable to ensure butt-end connection of the hollow cylinder with the tuyere, and a pusher disposed within the hollow cylinder at the other butt end thereof, with a feeder being mounted substantially in the middle portion within the hollow cylinder and made up of at least two compartments of which one compartment accommodates tube sections and the other one plugs, the interior of the hollow cylinder communicating with the interior of the feeder to thereby provide for alternate feeding of the tube sections and plugs from the feeder interior to the interior of the hollow cylinder and their further pusher-actuated transfer into the tuyere.

3 Claims, 3 Drawing Figures

METHOD OF INTRODUCING POWDERED REAGENTS INTO MOLTEN METALS AND APPARATUS FOR EFFECTING SAME

BACKGROUND OF THE INVENTION

I. Field of the Application

The present invention relates to metallurgy, and more particularly to a method and apparatus for introducing powdered reagents into molten metals.

The invention is adaptable for application in the production of cast iron, steel and nonferrous metals for accomplishing treatment, desulphurization, overheating and alloying thereof, as well as for the production of high-grade and high-strength cast irons with globular graphite directly in a melting apparatus, metallurgical vessel or in a ladle.

An ever growing production of alloying and special steels by the oxygen-converter process, widely practiced in industrially developed countries, requires an ever greater amount of refined cast irons free from harmful inclusions such as sulphur and phosphorus. This, in turn, stimulates the development of technological processes and equipment for the production of refined molten irons. These technological processes are needed to reduce the production cost of alloying and special steels; to minimize the consumption of powdered reagents and to enhance their efficiencies; to render the metal treating process effective and easily adaptable for mechanized and automatic performance.

There is widely used in modern practice a method for the treatment or desulphurization of liquid blast-furnace cast iron, according to which molten iron is treated with powder-like or lump reagents such as calcium carbide, lime and magnesium.

The above-mentioned method for treating liquid cast iron is not free from disadvantages, such as low efficiency of the reagents being used and high production cost of metal. In addition, the prior-art methods are inefficient by reason of the operating process being discontinuous.

There is also known a method of treating molten iron, which is effected by way of introducing fluidized powders into open-type ladles.

U.S. Pat. No. 2,803,533 describes a method of injecting fluidized powders for metallurgical treatment, according to which fluidized powders, for example, calcium carbide, are introduced through an injection tube into a molten metal to thereby accomplish its desulphurization.

According to another prior-art method of introducing various additives into a molten metal, a metallic tuyere is immersed into a molten metal contained in a ladle, through which various powdered reagents are introduced into the molten metal. As the molten metal is poured into the ladle, the end portion of the tuyere is melted down and the tuyere is gradually lowered.

Both methods described above are disadvantageous in that the tuyere is introduced into the molten metal through the surface layer thereof, which results in undesirable waste of metal due to metal splashing. In addition, these methods require substantial consumption of powdered reagents.

It is known to utilize an apparatus for carrying out desulphurization of liquid iron. This apparatus operates as follows. A powdered reagent, such as lime or calcium carbide, is fed onto the surface of liquid metal contained in a cast-iron ladle. A T-type mixer is introduced from above into the molten metal wherein it rotates about its axis while being driven from a motor through a reducer.

The molten metal starts to circulate and then comes into intimate contact with the powder reagent, whereby the efficiency of metal desulphurization is enhanced.

The disadvantage of the above-described apparatus lies in that the mixer is complicated and cumbersome in construction. The loss of metal due to its adherence to the mixer surface is likewise considerable. Furthermore, the apparatus is utilized inefficiently due to the fact that only half or two-thirds of the ladle volume is filled with molten metal, hence low throughput capacity of the ladle.

There is also known an apparatus for introducing powdered reagents into molten metal (cf. USSR Inventor's Certificate No. 293,855 cl. C 21c). The apparatus of this invention is operated so that powdered reagents are fed from a hopper into a molten metal through a tuyere immersed in metal for a depth of 1.4 to 1.5 times the entire depth of the metal layer.

The tuyere is made up of concentrically positioned steel tubes 20 to 110 mm in diameter. Each of said steel tubes is enclosed in a chamotte cylinder with refractory coating. The end portion of the tuyere is fitted with a refractory headpiece. The tuyere is immersed in the molten metal contained in a ladle by means of a rod which is fixed on a slide carriage. The rod is lifted by means of a hoist and goes down by gravity. To minimize metal losses due to spattering, only two-thirds of the ladle volume is filled with molten metal.

The apparatus described above suffers from several disadvantages, i.e. the tuyere is complicated in construction and has a short service life; the hoisting device for lifting and displacing the tuyere is cumbersome; it is necessary to introduce a maximum amount of powdered reagents in a short period of time; the efficiency of the powdered reagent is very low, just as the throughput capacity of ladles.

There is known a method of blowing powdered reagents into a molten metal, which consists in that a powdered reagent is fed in a stream of gas into the lower layers of molten metal through a tuyere. After a given amount of the powder reagent required for desulphurization has been fed, its feeding is discontinued and the blowing system is used for the air or oxygen supply.

This method has a disadvantage which resides in that the molten metal is floured under pressure into the tuyere, as the blowing operation is discontinued, wherein it solidifies thus making the latter inoperative.

To avoid this deficiency, a flow of gas should be fed into the metal container, which, however, is undesirable for this will cause a change in the chemical composition of the metal and premature wear-out of the tuyere.

In addition, the above method is not adapted for the application where vessels, such as open-type ladles, are used.

There is also known an apparatus for introducing powdered reagents into molten metals, which comprises a connection pipe built into the refractory lining of a container and provided with a changeable plug and a slidable tube positioned therein and accommodating a changeable plug and a rod. The lateral side of the tube is formed with a hole equal in diameter to the inlet opening of the connection pipe. The slidable tube is welded to the connection pipe of the tube, thereby providing for the supply of powdered reagents.

This type of apparatus is only suitable for use where only stationary mounted containers are employed, and unsuitable for use with movable or non-stationary ones.

In addition, the pipeline system of the apparatus is often-times clogged with powdered reagents.

OBJECTS

It is an object of the present invention to provide a method of introducing powdered reagents under the layer of molten metal, which will enable the efficiency of the powdered reagents to be enhanced during desulphurization of metal and the production cost of the metal being treated to be reduced.

It is also an object of the present invention to provide an apparatus for performing the method of introducing powdered reagents under the layer of molten metal, which will be smaller in capacity, simple in construction and easy in operation, permitting a stream of metal to be easily stopped.

Another object of the invention is to adapt such apparatus for application where both stationary and movable metallurgical vessels containing molten metal are used.

Still another object of the invention is to provide an apparatus which will feature improved operating reliability and performance characteristics, also permitting the process of treating molten metal to be improved.

SUMMARY OF THE INVENTION

These and other objects and features of the invention are accomplished by the provision of a method of introducing powdered reagents into a layer of molten metal in a stream of carrier gas through a tuyere disposed in a refractory lining of a metallurgical vessel, wherein, according to the invention, powdered reagents are introduced into a molten metal at the feed rate of 0.04 to 0.6 kg per sec. under a pressure of carrier gas which is 1.8 to 4.0 times the static pressure of the molten metal above the tuyere, with the powder-to-carrier-gas ratio being 3 to 35 kg per cubic meter.

The powdered reagents having a boiling point lower than the temperature of the molten metal are preferably introduced into the molten metal at the feed rate of 0.04 to 0.07 kg per sec. under a pressure of carrier gas which is 1.8 to 2.4 times the static pressure of molten metal above the tuyere, with the powder-to-carrier-gas ratio being 3 to 5 kg per cubic meter.

The powdered reagents having a boiling point higher than the temperature of the molten metal are preferably introduced into a molten metal at the feed rate of 0.07 to 0.6 kg per sec. under a pressure of carrier gas which is 2.4 to 4.0 times the static pressure of the molten metal above the tuyere, with the powder-to-carrier-gas ratio being maintained within the range of 3 to 35 kg per cubic meter.

The efficiency of powdered reagents is enhanced with the method of the invention due to the fact that powdered reagents are introduced into lower layers of molten metal, which makes it possible to increase the surface of contact of the powder particles with the molten metal and with the elements making up its composition.

The method of the invention permits the amount of fumes and the loss of metal caused by its splashing to be minimized by way of introducing powdered reagents into the lower layers of molten metal.

The powdered reagents used in the method of the invention can be fed for a lengthy period of time, which makes it possible to step down the powder feed rate and the speed of the vigorously proceeding reaction.

With the method of the invention it becomes feasible to treat any amount of metal, and to use volatile and refractory powders as reagents.

The objects and features of the invention are also attained in an apparatus for performing the method of the invention, comprising a tuyere built into a refractory lining of a metallurgical vessel and accommodating in its interior a tube axially movable therealong and fitted with a plug and through which a powdered reagent is introduced in a stream of carrier gas into the vessel, according to the invention, the tube is made up of separate sections each being smaller in length than the thickness of the refractory lining of the vessel, and positioned on the outside of the tuyere is a feed device made in the form of a hollow cylinder mounted on its drive operable to ensure butt-end connection of the hollow cylinder with the tuyere, and disposed within the hollow cylinder at the other end thereof is a pusher, said hollow cylinder accommodating approximately in its middle portion a feeder made up of at least two compartments of which are compartment accommodates tube sections and the other one plugs, the interior of the hollow cylinder communicating with the interior of the feeder to thereby provide for alternate feeding of the tube sections and plugs from the feeder interior to the interior of the hollow cylinder and for their further transfer by means of the pusher into the tuyere.

The feeder is preferably made up of three compartments of which one accommodates sections of tubes with the inside diameter thereof being 15 to 20 percent larger than the outside diameter of the tube sections positioned in the second compartment, the third compartment accommodating metal balls with the diameter thereof being 10 to 20 percent smaller than the inside diameter of the tube sections positioned in the first compartment of the feeder and 5 to 15 percent larger than the inside diameter of the tubes disposed in the second compartment, the tube sections of smaller diameter and the ball being used as a plug.

The apparatus for effecting the method of the invention makes it unnecessary for the tuyeres to be immersed in molten metal and therefore, does not need a mechanism for lifting and lowering them.

The apparatus of the invention is several times smaller in capacity than the prior-art apparatus, it requires less expense for its construction and lends itself easily to automatic performance.

BRIEF DESCRIPTION OF THE DRAWINGS

The invention will be further described, by way of example only, with reference to the accompanying drawings, wherein.

DETAILED DESCRIPTION OF THE PREFERRED EMBODIMENTS

The method according to the invention for introducing powdered reagents into a layer of molten metal is carried out in the following manner.

Figure 1:
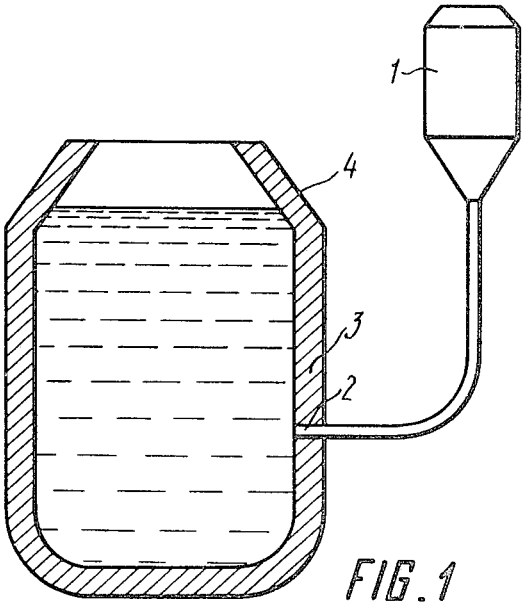
FIG. 1 schematically illustrates a method of introducing powder reagents into a layer of molten metal.

A powdered reagent charged into a hopper 1, shown in FIG. 1, is then fed therefrom in a stream of carrier gas through a tuyere 2 built in a refractory lining 3 of a metallurgical vessel 4 containing molten metal, into a layer of said metal.

The powdered reagent reacts with sulphur contained in the metal to thereby enable its desulphurization.

It is necessary for the powder feed rate to be correlated with the carrier-gas pressure and with the powder-to-carrier-gas ratio.

Depending upon the selection of a powdered reagent, the powder feed rate is preferably maintained within the range of from 0.04 to 0.6 kg per sec.

If the powder feed rate is reduced, the operating cycle of tapping metal from the vessel 4 will be disturbed and last for a longer period of time.

The pressure of carrier gas has been found to have considerable effect upon the method of the invention. To overcome the ferrostatic pressure of the metal above the tuyere and to enable the injection of powdered reagent, the pressure of carrier gas should preferably exceed the counter-acting pressure of the molten metal. If, however, the pressure of the carrier gas exceeds the pressure of the molten metal by a minimum value, the tuyere 2 will be clogged with the metal, whereas a substantially higher pressure value thereof will cause splashing of metal from the vessel 4.

An optimum value of the carrier-gas pressure, depending upon the selection of the powdered reagent, has been found to be 1.8 to 4.0 times the value of the static pressure of the molten metal above the tuyere.

The feeding of a powdered reagent is effected by means of a carrier gas, which is compressed air in this case. When introduced into the molten metal, compressed air reacts therewith to oxidize and cool the latter, this being extremely undesirable. With the powder-to-carrier-gas ratio being more than 3 to 35 kg per cubic meter, the powder feed conduit is clogged up.

An appropriate correlation of the process parameters enables powdered reagents to be introduced into a molten metal without any appreciable amount of metal being spattered from the vessel 4, the formation of fumes and the danger of explosion being insignificant.

By effecting the treatment of molten metal with powdered reagents within the above-indicated range of the process parameters, the efficiency of the powdered reagents, as well as the process efficiency, are enhanced.

By selecting optimum values of the process parameters mentioned above, it becomes possible to regulate the time period required for effective treatment of molten metals, thus allowing the speed of the vigorously proceeding reaction to be stepped down.

Moreover, the method of the invention permits any amount of molten metal to be treated and various volatile and refractory powdered reagents to be introduced thereinto.

The invention will be further described with reference to illustrative Examples.

Granulated magnesium which evaporates at the temperature of molten metal was used as the powdered reagent.

EXAMPLE 1

This powdered reagent was introduced into the molten metal under a pressure of a carrier gas 1.8 times the static pressure of the molten metal above the tuyere. If the controllable pressure is less than 1.8 times the static pressure of the molten metal above the tuyere, the feeding rate of the granulated magnesium will be stepped down and the end portion of the tuyere 2 in contact with the molten metal may become clogged.

The granulated magnesium was blown into the molten metal at a feeding rate of not less than 0.04 kg per sec. With a feeding rate less than that mentioned above, the penetrating power of the granules is lowered to adversely affect the bubbling of the molten metal and the rate of its mixing with the powdered reagent over the entire volume of the vessel 4.

The minimum powder-to-carrier-gas ratio should be 3 kg per cubic meter.

EXAMPLE 2

Granulated magnesium was introduced into the molten metal under a pressure of carrier gas 2.1 times the static pressure of the molten metal above a tuyere, at the powder feeding rate of 0.05 kg per sec., the powder-to-carrier gas ratio being 4 kg per cubic meter. The optimum values selected for the process parameters allow the degree of metal desulphurization to be increased 65 to 80 percent at a minimum consumption of granulated magnesium; the efficiency of the powdered reagent, granulated magnesium in this case, being as high as 90 percent.

EXAMPLE 3

Granulated magnesium was introduced into the molten metal under a pressure of carrier gas 2.4 times the static pressure of the molten metal above the tuyere.

With the pressure of carrier gas less than 2.4 times the static pressure of the molten metal above the tuyere, the bubbling of the metal becomes vigorous enough to cause metal splashing, since apart from the pressure of the carrier gas additional pressure is created due to evaporation of the magnesium granules. The formation of fumes and the pyroeffect are likewise increased.

The maximum powder feeding rate was found to be 0.07 kg per sec. An increase in the powder feeding rate resulted in that the granules of magnesium, not having sufficient time to react with the metal, evaporated and were discarded to slag to burn therein. This, in turn, led to higher consumption of magnesium and to impaired efficiency thereof.

The maximum ratio of granulated magnesium to compressed air was found to be 3 kg per cubic meter.

With the above ratio higher than that indicated above, the efficiency of magnesium was found to be materially lower, which is due to the fact that magnesium vapor, not having sufficient time to react with sulphur, escapes to the atmosphere as fumes; in addition, the loss of metal due to splashing was also increased.

Another embodiment of the invention will be further described with reference to the following illustrative Examples, wherein calcium carbide, lime and soda ash were used as the powdered reagents, which do not evaporate at the temperature of the liquid metal.

EXAMPLE 4

When utilizing such powdered reagents as calcium carbide, lime and soda ash, these can be introduced into a molten metal, such as cast iron, under a pressure of carrier gas being 2.4 times the static pressure of the molten metal above the tuyere. This is necessary to cause bubbling of the molten metal and to provide for effective mixing of the powder particles with the metal.

The powdered reagents should be introduced at a feeding rate of 0.07 kg per sec, and at the powder-to-carrier-gas ratio 3 kg per cubic meter.

EXAMPLE 5

Calcium carbide, lime and soda ash were introduced into a molten metal under a pressure of carrier gas 3.0 times the static pressure of the molten metal above the tuyere, at a feeding rate of the powdered reagents of 0.4 kg per sec., the ratio of powder reagent to carrier gas being 20 kg per cubic meter.

The degree of metal desulphurization was found to be 55 to 70 percent, the efficiency of the powdered reagent being 55 to 70 percent.

EXAMPLE 6

Calcium carbide, lime and soda ash were introduced into a molten metal under a pressure of carrier gas 4 times the static pressure of the molten metal above the tuyere. This resulted in the most effective mixing of the particles of the powdered reagent with the molten metal, the efficiency of its utilization being enhanced accordingly. An increase in this pressure leads to higher losses of metal due to splashing.

The powder feeding rate at such pressure can be brought up to 0.6 kg per sec.

At a higher rate of feeding, the particles of the powdered reagent, having no time to react with the molten metal, are blown onto the surface of molten metal and are discarded to slag, thereby increasing the consumption of the powdered reagent used.

The ratio of powdered reagent to carrier gas was 35 kg per cubic meter. A higher ratio may cause clogging of the tuyere.

Figure 2:
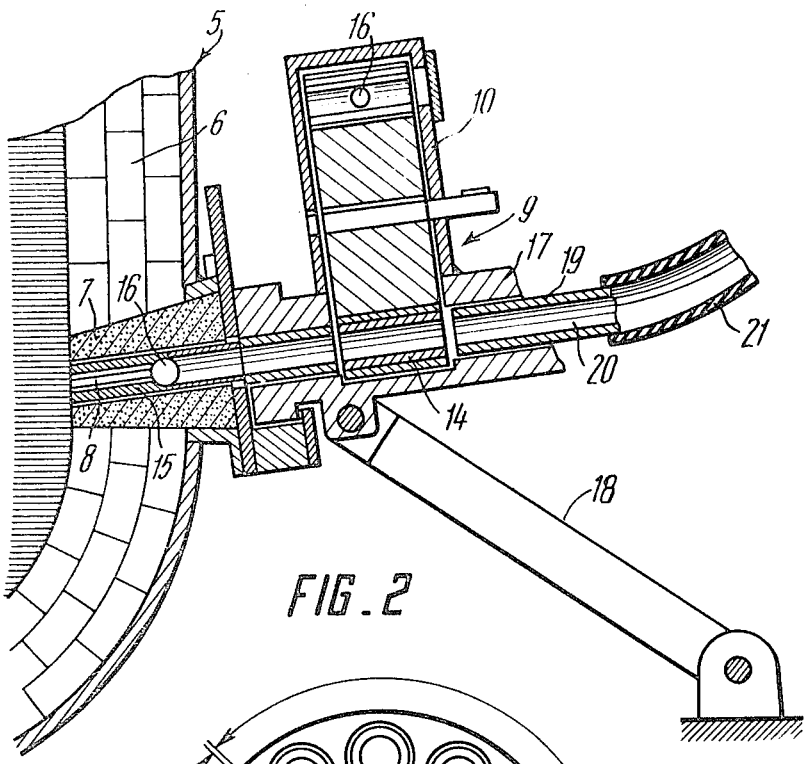
FIG. 2 is a sectional view of an embodiment of the invention, having a feeder made up of three compartments.

The invention also provides an apparatus for performing the method of the invention, which comprises a metallurgical vessel 5, shown in FIG. 2, containing a molten metal and formed with a refractory lining 6. Built in the refractory lining 6 of the vessel 5 below the surface level of the molten metal is a graphite tuyere 7 with a plug 8.

Figure 3:
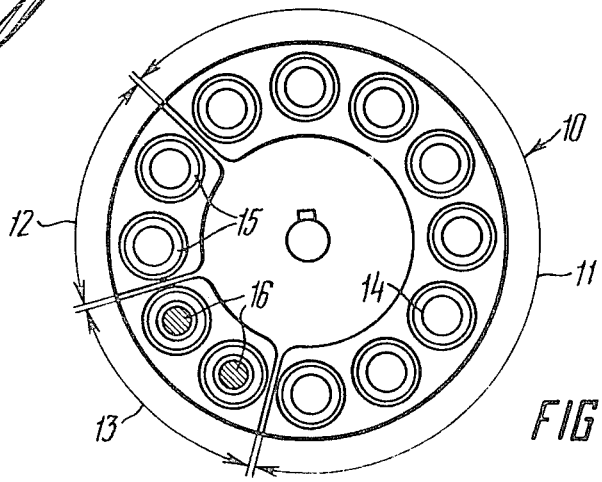
FIG. 3 is a cross-sectional view of a feeder adapted to accommodate sections of pipes and metal balls.

Mounted on the outside of the tuyere 7 is a feed device 9 which comprises a feeder 10 formed with three compartments 11, 12 and 13, shown in FIG. 3, respectively accommodating tubes 14 with the largest inside diameter, tubes 15 having an inside diameter 15 to 20 percent smaller than the inside diameter of the tubes 14 positioned in the compartment II, and balls 16 with the diameter thereof being 5 to 15 percent larger than the inside diameter of the tubes 15 positioned in the compartment 12, and 10 to 20 percent smaller in diameter than the tubes 14 disposed in the first compartment 11.

The feeder 10 (FIG. 2) is mounted for axial movement in the middle portion of a hollow cylinder 17, thereby ensuring alternate feeding of the tubes 14,15 and of the balls 16 to the interior of the hollow cylinder 17. The hollow cylinder 17 is pivotally connected to its actuator 18 operable to provide for the butt-end connection of the hollow cylinder 17 with the tuyere 7.

At the other end of the hollow cylinder 17 there is mounted in its interior a pusher 19 formed with a conduit 20 connected with a flexible hose 21 through which a powdered reagent is fed into a molten metal contained in the container 5.

The apparatus of the invention operates in the following manner.

First, the tuyere 7 is connected to the hollow cylinder 17 by means of the actuator 18.

Fed into the interior of the hollow cylinder 17 from the compartment 11 of the feeder 10 is the tube 14 having an inside diameter of 15 mm and being moved by means of the pusher 19 along the conduit formed by the tuyere 5 and the hollow cylinder 17.

Next, the pusher 19 is returned to its original position and the feeder 10 is turned relative to the hollow cylinder 17 through a given angle sufficient to ensure axial alignment of the pusher 19 with the next tube 14 disposed in the compartment 11 of the feeder 10.

The pusher 19 reciprocates to feed the tubes 14 until the plug 8 is pushed out into the vessel 5 containing molten metal.

Simultaneously with the feeding of the tubes 14, a carrier gas is passed through the conduit 20 to the pusher 19; and as the plug 8 is pushed out, a powdered reagent is fed in a stream of carrier gas.

Several minutes before completion of the metal treating operation, the feeder 10 is turned to bring the tube 15, having a diameter of 12 mm and disposed in the compartment 12, in axial alignment with the pusher 19.

After feeding one tube 15, the tubes 14 continue to be fed until the tube 15 occupies the extreme left position in the graphite tuyere 7. As this happens, the feeding of the powdered reagent is discontinued and the metal ball 16 having a diameter of 13 mm, starts rolling under the action of the carrier gas from the compartment 13 of the feeder 10 up to the stop at the tube 15 having an inside diameter of 12 mm. The ball 16 blocks the passage of carrier gas, it being compressed air in the given case, while the tube 15 continues to be filled with the molten metal until it gets in contact with the ball 16, whereupon the metal solidifies to form a plug therewith.

Thereafter, the actuator 18 is used to disconnect the vessel 5 from the feeding device 9 which is returned to idle position.

The apparatus of the invention is simple in construction and easy in operation. It is readily adaptable for use with a movable container such as an open-type ladle. A stream of molten metal is easily stopped in the apparatus. The process of treating molten metal is variable at will. In addition, the apparatus is reliable in operation.

What is claimed is:

1. A method of introducing powdered reagents into a molten metal in a stream of carrier gas through a tuyere disposed in a refractory lining of a metallurgical vessel, consisting in introducing powdered reagents into the molten metal at a feed rate of 0.04 to 0.6 kg per sec. under a pressure of carrier gas which is 1.8 to 4.0 times the static pressure of molten metal above the tuyere, with the powder-to-carrier-gas ratio being 3 to 35 kg per cubic meter.

2. A method of introducing powdered reagents into a molten metal as claimed in claim 1, wherein powdered reagents having a boiling point lower than the temperature of the molten metal are introduced into the molten metal at a feed rate of 0.04 to 0.07 kg per sec. under a pressure of carrier gas which is 1.8 to 2.4 times the static pressure of the molten metal above the tuyere, with the powder-to-carrier-gas ratio being maintained within the range of from 3 to 5 kg per cubic meter.

3. A method of introducing powdered reagents into a molten metal as claimed in claim 1, wherein powdered reagents having a boiling point higher than the temperature of molten metal are introduced into a molten metal at the feed rate of 0.07 to 0.6 kg per sec. under a pressure of carrier gas which is 2.4 to 4.0 times the static pressure of the molten metal above the tuyere, with the powder-to-carrier-gas ratio being 3 to 35 kg per cubic meter.

* * * * *